United States Patent [19]

Tait et al.

[11] Patent Number: 5,054,258

[45] Date of Patent: Oct. 8, 1991

[54] CAPSULE TRANSPORT TRAY

[75] Inventors: Charles N. Tait, Manheim; Ralph A. Volpe, Landisville, both of Pa.

[73] Assignee: Warner-Lambert Company, Morris Plains, N.J.

[21] Appl. No.: 469,612

[22] Filed: Jan. 24, 1990

Related U.S. Application Data

[62] Division of Ser. No. 144,122, Jan. 15, 1988, Pat. No. 4,922,682.

[51] Int. Cl.[5] ..... B65B 51/02; B65B 35.24

[52] U.S. Cl. ..... 53/137.2; 53/329; 53/376.2; 53/900; 198/803.14

[58] Field of Search ..... 53/900, 329, 478, 560, 53/139.3, 131, 376.2, 329.4, 377.4, 137.2; 198/803.14, 713, 711, 712, 706, 797

[56] References Cited

U.S. PATENT DOCUMENTS

| | | | |
|---|---|---|---|
| 3,044,651 | 10/1961 | Manspeaker et al. | 198/803.14 X |
| 3,182,786 | 5/1965 | Reimers | 198/803.14 X |
| 3,200,556 | 8/1965 | Ackley | 53/900 X |
| 3,580,381 | 5/1971 | Kilner | 198/803.14 X |
| 3,804,583 | 4/1974 | Parkes | 198/803.14 X |
| 3,822,010 | 7/1974 | Thompson et al. | 198/803.14 |
| 3,866,737 | 2/1975 | Simon | 198/803.14 X |
| 4,560,139 | 12/1985 | Dahlke | 198/804.14 X |
| 4,584,817 | 4/1986 | Yamamoto et al. | 53/900 X |
| 4,756,902 | 7/1988 | Harvey et al. | 53/478 X |
| 4,761,932 | 8/1988 | Harvey et al. | 53/329 |
| 4,793,119 | 12/1988 | Maso | 53/900 X |
| 4,802,323 | 2/1989 | Garris et al. | 53/900 X |

*Primary Examiner*—Horace M. Culver
*Attorney, Agent, or Firm*—Craig M. Bell

[57] ABSTRACT

An improved capsule transport tray for use in the curing chamber of capsule sealing and banding machines is disclosed. The trays have hemispherical recesses which thereby support the capsules at their ends, thereby keeping the midportion of the capsules where the sealing and banding solutions have been applied, from touching the support surface. An air port or opening at the bottom of each recess insures better circulation of the heated air in the curing chamber about each respective capsule.

6 Claims, 3 Drawing Sheets

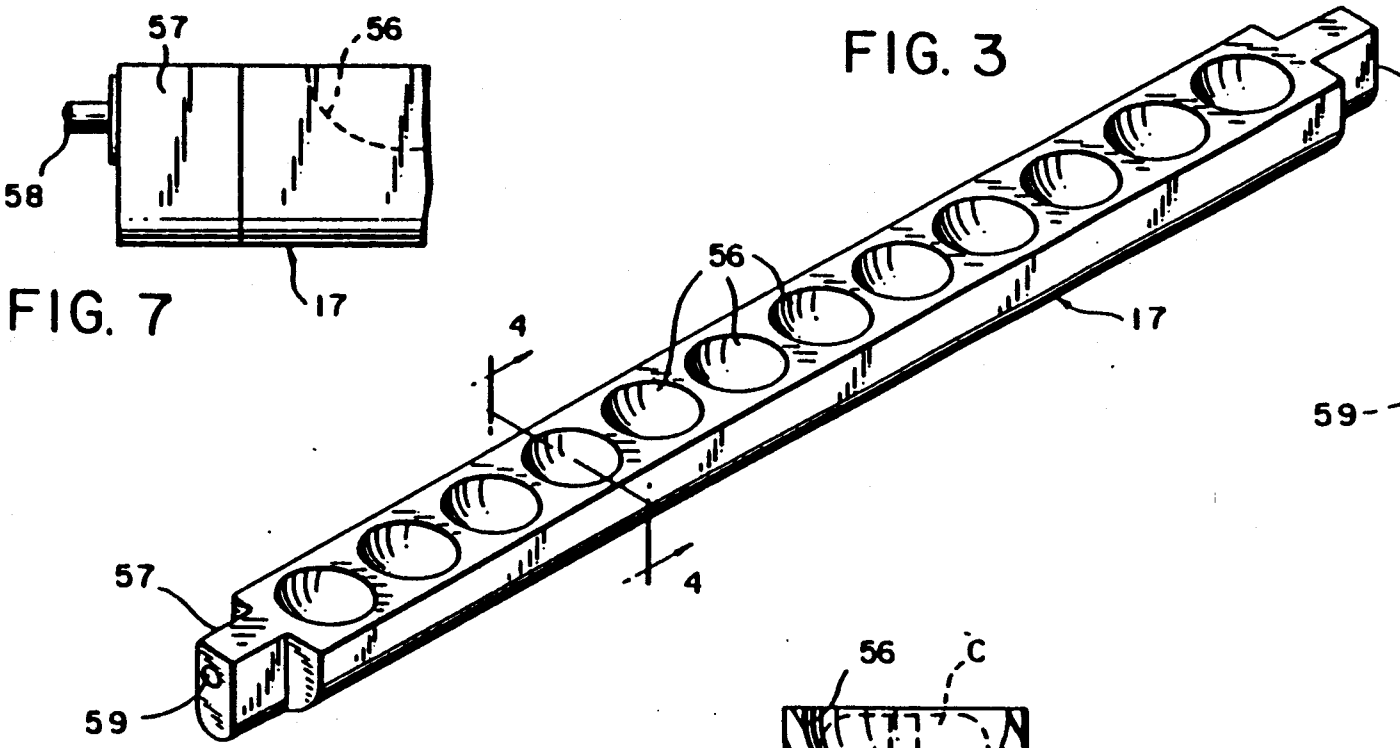
FIG. 3
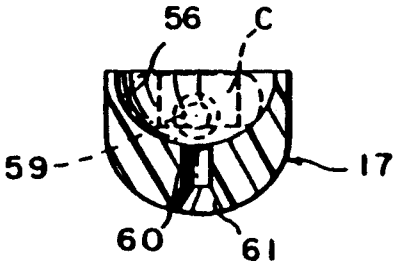
FIG. 4
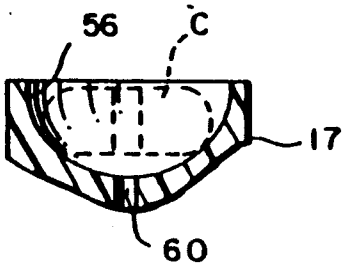
FIG. 5
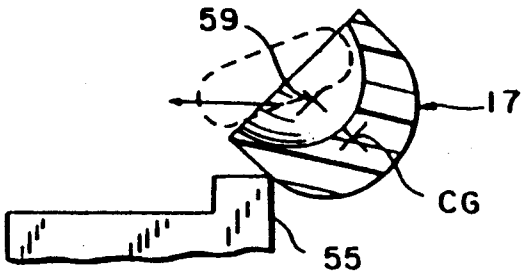
FIG. 6
FIG. 7

CAPSULE TRANSPORT TRAY

RELATED APPLICATIONS

The present application is a divisional application derived from U.S. Ser. No. 07/144,122 filed on Jan. 15, 1988, now U.S. Pat. No. 4,922,682.

BACKGROUND OF THE INVENTION

This invention relates to capsule sealing and banding machines, and, more particularly, to an improved capsule support tray used as a component of these machines and a method for drying the capsules.

One manner of protecting gelatin capsules from tampering has been the placing of a gelatin band formed in situ around the juncture of a capsule cap and body after the capsule has been filled. U.S. Pat. No. 4,756,902, filed July 25, 1986, by Harvey, et. al., discloses a liquid sealing process for joining gelatin capsule segments which can also be performed on machines used conventionally for capsule banding. When performed on such a banding machine, this process involves the replacement of the fluid gelatin used for banding with a sealing fluid mixture comprising alcohol, e.g. ethanol and water, heated to a temperature of 40° C. to 60° C. The fluid is applied by contacting the juncture between cap and body with the solution from a reservoir conventionally filled with gelatin and positioned below the banding table by means, e.g., of a print wheel. One of the variants contemplated by the Harvey, et. al., application is the sequential application of both a sealing fluid and a banding fluid on the same machine.

In conventional banding and/or sealing machines, the capsules are fed from a supply hopper to a rotating banding table or product transfer plate via a complex set of cams, levers and push rods. This capsule feed structure has a large number of moving parts, is difficult to adjust, prone to wear and difficult to maintain in proper adjustment. Moreover, any breakdown in the feed apparatus is time-consuming and expensive to repair, and the nature of the capsule feed structure limits the number of capsule banding stations or slots which can be provided on the transfer plate. For example, one typical prior art capsule banding machine in widespread use has only six tracks or banding slots in the transfer plate.

Further, in a conventional banding or sealing machine, the capsules are conveyed by the banding table or product transfer plate to a plurality of capsule-receiving outlet transport trays which convey the capsules through a curing chamber to be cured or dried and thence to a suitable outlet or collection point. In one typical machine, these trays comprise elongate, curvilinear, trough-like devices which support the capsules on their sides. With this arrangement, the sealing material on the capsule engages the tray and may be damaged before it becomes fully dry.

Additionally, in prior art machines it is necessary to at least partially disassemble the machine in order to remove the pot or reservoir containing the sealing or banding fluid.

In other prior art machines, the capsule feed means which supplies capsules to the transfer plate incorporated rigid means to regulate the movement of capsules from the discharge end of the feed means to the transfer plate. Although it functions satisfactorily, this arrangement may result in jamming of the capsules or damage to them.

SUMMARY OF THE INVENTION

The present invention comprises an improved capsule transport tray for carrying the capsules through the capsule curing chamber. These trays may be used in any standard capsule sealing and banding machine of the prior art but are particularly useful in the machine as set forth in copending application U.S. Ser. No. 07/144,122 filed on Jan. 15, 1988. The trays have means for supporting the capsules essentially only at their ends, thereby keeping the midportion of the capsules, where the sealing and banding fluids have been applied, from touching the support surface.

DESCRIPTION OF THE DRAWINGS

FIG. 3 is an enlarged perspective view of the capsule transport tray of the invention;

FIG. 4 is a transverse view in section taken along line 15—15 in FIG. 4;

FIG.5 is an enlarged fragmentary view in section of the tray of FIG. 5, showing how a capsule or other object is supported at its ends in the tray;

FIG. 6 is a somewhat schematic view showing how the capsule tray engages the trip device at the discharge point from the drying chamber in order to dislodge capsules from the tray and into a suitable receptacle; and FIG. 7 is an enlarged, fragmentary view in elevation of an end portion of the tray of FIG. 7.

DETAILED DESCRIPTION OF THE INVENTION

Figure 1:
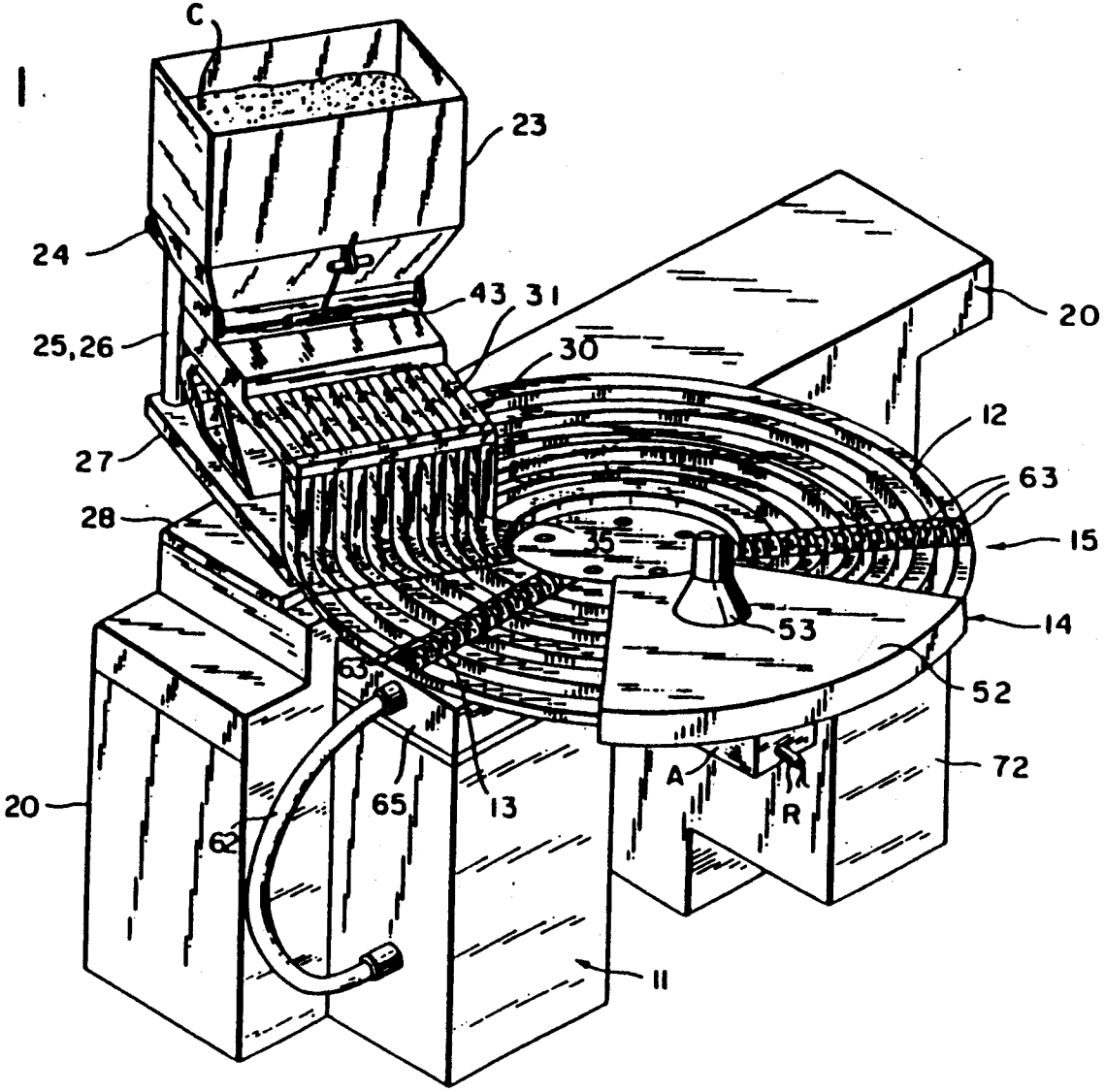
FIG. 1 is an overall schematic representation of a sealing and banding machine within which the trays of the present invention are useful.

Referring more specifically to the drawings, a capsule sealing and banding machine is indicated generally in FIG. 1. The sealing and banding machine comprises a housing 11 on which is supported a rotating product transfer plate or banding table 12 for moving capsules C past a capsule sealing apparatus 13 and thence through a heating/drying chamber 14 for at least partially drying and curing the sealing fluid to form a unitary capsule cap and body structure. Thereafter, the transfer plate conveys the capsules past a banding apparatus 15 for application of a banding fluid such as gelatin. The sealed and banded capsules are then conveyed by the transfer plate 12 to a discharge station 16, (FIG. 2) where the capsules are picked up by the transport trays 17 of the present invention. The product transport trays 17 are carried by suitable conveying means such as chains 18 or the like disposed about a plurality of drive and idler sprockets 19 arranged so that the trays are moved through a serpentine path in capsule curing-/holding chamber 20. At the discharge end of the chamber, the trays 17 are carried by the chains past a trip device 21 lying in their path, whereby the capsules carried thereon are dislodged or dumped from the trays and into a suitable receptacle 22.

Figure 2:
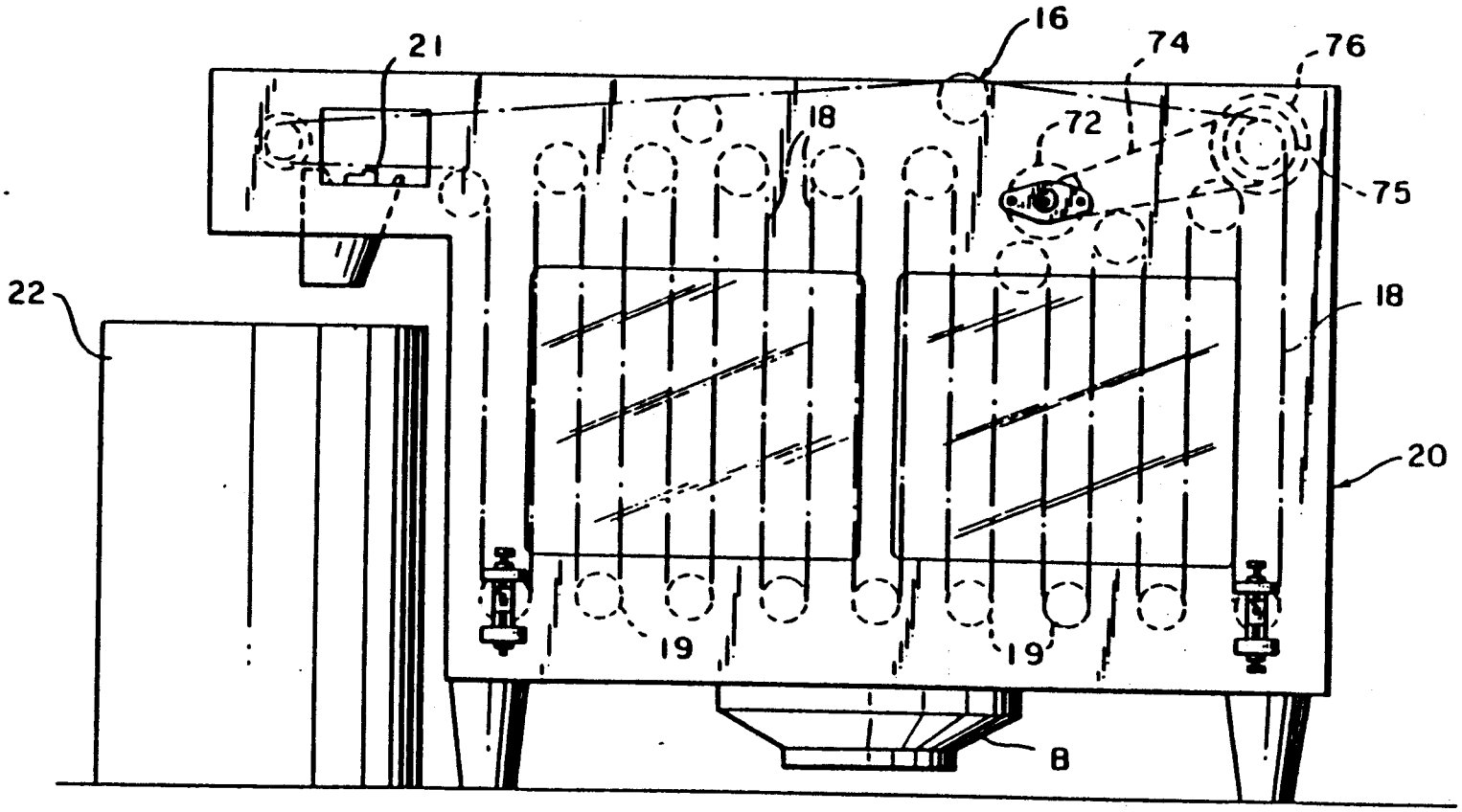
FIG. 2 is a rear side view in elevation of the machine disclosed in FIG. 1 with portions removed disclosing the curing chamber of the present invention.

The capsule transport trays of the present invention move along a serpentine path in the curing and holding chamber (FIG. 2). This occurs subsequent to application of the sealing and banding solutions and at this station the capsule transport trays 17 are elevated in their path of movement (see FIG. 2) so that they engage and remove the capsules from the transfer plate through an opening 54 in the top wall of curing/holding chamber 20. Thereafter, the chains 18 and thus the capsule transport trays 17 and capsules carried thereby are caused to move through a serpentine path as they advance through the curing/holding chamber 20. Warm air is caused to circulate through this chamber to thoroughly dry and cure the banding and sealing fluids applied to the capsules. As noted previously, after the capsules have been conveyed through their serpentine path in the curing/holding chamber they move past a "trip" or "dump" station 21, where the trays engage an abutment 55 (FIG. 6) and are caused to pivot about a longitudinal axis, dumping the capsules carried thereby into a suitable receptacle 22.

The capsule transport trays 17 are shown in greater detail in FIGS. 3 through 7. In the example shown, the trays are approximately 28 centimeters long and have twelve hemispherical recesses 56 uniformly spaced along the top surface thereof. The recesses will accommodate several different sizes of capsules, including sizes #3 and #4. An axially extending pivot mount 57 projects from each of the opposite ends of the tray for pivotally attaching the tray to the chains 18 via pins 58 Which are attached to the chains and extend into pivot openings 59 in the ends of the pivot mounts. An air port 60 communicates through the bottom of the recess with a core or funnel-shaped entry section 61 in the bottom of the tray whereby upwardly flowing air in the curing chamber 20 is guided into the entry section and thence upwardly through port 60 and past the capsule held in the recess 56. This results in circulation of drying air completely around the capsule, ensuring thorough drying of the sealing and banding fluids. The air may be circulated by suitable means B. With this unique construction of the transport tray, the capsules are supported at their ends, while remaining free to move about and rotate around their longitudinal axis, exposing all sides to the drying air. Moreover, by being supported at their ends (virtually a point contact) the banding and sealing fluids do not contact any of the supporting surface and thus are enabled to thoroughly dry and/or cure without likelihood or danger of being damaged from contact with a part of the machine.

The tray may be made from any suitable material, including plastics and metals and may be stamped, molded or otherwise suitably formed. For use in the application described herein, the tray must be non-alcohol absorbent, non-wetting, rigid and capable of withstanding temperatures of up to about 140° F. As shown best in FIGS. 4, 5 and 6, the center of gravity CG of the trays 17 is below the pivot attachments, whereby the trays are suspended or hang in an upright position during their movement through the curing chamber.

The curing/holding chamber 20 may be unbolted from the main housing, if desired. This enables different curing/holding chambers to be easily and quickly substituted for one another. This feature may utilized, for example, to substitute capsule transport trays designed to accommodate different size capsules.

Although the invention has been described with reference to particular embodiments, it is to be understood that these embodiments are merely illustrative of the application of the principles of the invention. Numerous modifications may be made therein and other arrangements may be devised without departing from the spirit and scope of the following claims.

What we claim is:

1. In a machine for applying a banding or sealing fluid to a capsule, said machine having capsule supply means, means for applying at least one of a capsule sealing or banding fluid to the capsule, and capsule curing means, and wherein a rotating capsule transfer plate receives the capsules from the capsule supply means and conveys them past the means for applying a sealing or banding fluid and to the capsule curing means, the improvement comprising:

capsule support trays that are carried or a flexible conveyor means constrained to move along a serpentine path through an enclosed capsule curing chamber; and a plurality of hemispherical recesses of continuous curvature forming circular apertures in the top surface of each tray for supporting the capsules, said recesses each being configured to hold a single capsule and to support the capsule at its opposite ends, with the midportion of the capsule being spaced from contact with any part of the tray and the capsule being free to rotate about the normal axis of the capsule, whereby all sides of the capsule are exposed to a circulating air flow.

2. In a machine as claimed in claim 1, wherein:

said capsule transport trays are elongate in a direction transverse to their path of movement through the curing chamber and are pivotally supported at their opposite ends on spaced chains disposed parallel to one another at opposite sides of the chamber.

3. In a machine as claimed in claim 2, wherein:

an air passage extends through the tray from the bottom surface thereof to the recess, whereby air is enabled to flow into the recess from the bottom and thence upwardly around the capsule supported in the recess.

4. In a machine as claimed in claim 2, wherein:

an abutment is positioned in the capsule curing chamber in the path of movement in the capsule transport trays so that the trays engage the abutment and are pivoted about their pivot supports to tilt the trays and dump the capsules carried thereby into a suitable receptacle.

5. In a machine for applying a banding or sealing fluid to a capsule, said machine having capsule supply means, means for applying at least one of a capsule sealing and banding fluid to the capsule, and capsule curing means, and wherein a rotating capsule transfer plate receives the capsules from the capsule supply means and conveys them past the means for applying a capsule banding or capsule sealing fluid to the capsule and the capsule curing means, the improvement comprising;

capsule transport trays in the capsule curing means to receive the capsules from the capsule transfer plate and convey them through the curing means, said trays being supported at their opposite ends on conveying means at opposite sides of the curing means and each having a plurality of hemispherical recesses of continuous curvature forming circular apertures in said trays for supporting the capsules, the recesses being dimensioned so that the capsules are supported only at their opposite ends and the midportion thereof remains spaced from the tray.

6. In a machine as claimed in claim 5, wherein:

the curing means comprises a curing chamber and the conveying means and trays are constrained to move through the chamber from one end to the other thereof in a serpentine path, said trays having pivot attachments at their opposite ends and being pivotally supported on the conveying means, and said trays having their center of gravity lower than the pivot attachments whereby the trays are suspended with free-swinging movement from their pivot attachments.

* * * * *